US008499712B2

(12) United States Patent
Jakobsson

(10) Patent No.: US 8,499,712 B2
(45) Date of Patent: Aug. 6, 2013

(54) DEVICE FOR REMOVABLE ATTACHMENT OF A FLAG ON A FLAGPOLE

(75) Inventor: Magnus Jakobsson, Västerås (SE)

(73) Assignee: KSAB Golf Equipment Aktiebolag, Vasteras (SE)

( * ) Notice: Subject to any disclaimer, the term of this patent is extended or adjusted under 35 U.S.C. 154(b) by 330 days.

(21) Appl. No.: 12/883,573

(22) Filed: Sep. 16, 2010

(65) Prior Publication Data

US 2011/0067621 A1 Mar. 24, 2011

Related U.S. Application Data

(60) Provisional application No. 61/267,504, filed on Dec. 8, 2009.

(30) Foreign Application Priority Data

Sep. 21, 2009 (SE) ..... 0950689

(51) Int. Cl.
*G09F 17/00* (2006.01)
*A63B 57/00* (2006.01)

(52) U.S. Cl.
USPC ..... 116/173

(58) Field of Classification Search
USPC ..... 116/173, 174, 175; 428/28; 473/176; D11/165, 166, 181
See application file for complete search history.

(56) References Cited

U.S. PATENT DOCUMENTS

| | | | | |
|---|---|---|---|---|
| 1,748,625 | A * | 2/1930 | Troth | 116/173 |
| 2,869,507 | A * | 1/1959 | Boyer | 116/173 |
| 3,587,520 | A * | 6/1971 | Miller | 116/173 |
| 3,732,845 | A * | 5/1973 | Istre | 116/173 |
| 3,948,210 | A * | 4/1976 | Van Rijn | 116/173 |
| 5,615,635 | A * | 4/1997 | Deviney | 116/173 |
| 5,857,798 | A * | 1/1999 | Flynn | 403/256 |
| 6,848,388 | B2 * | 2/2005 | Shields | 116/173 |
| 7,004,103 | B2 * | 2/2006 | Chen | 116/28 R |
| 7,062,873 | B2 * | 6/2006 | Hlavin | 40/607.1 |
| 7,334,535 | B1 * | 2/2008 | Somers et al. | 116/173 |
| 8,187,113 | B2 * | 5/2012 | Lim | 473/176 |
| 2001/0022153 | A1 * | 9/2001 | Okumura et al. | 116/173 |
| 2005/0098084 | A1 * | 5/2005 | Puett | 116/173 |
| 2006/0260532 | A1 * | 11/2006 | Hlavin | 116/174 |
| 2011/0197803 | A1 * | 8/2011 | May | 116/173 |

FOREIGN PATENT DOCUMENTS

| | | | |
|---|---|---|---|
| JP | 10039815 | A * | 2/1998 |
| JP | 2001075517 | A * | 3/2001 |
| WO | WO 9721205 | A1 * | 6/1997 |

* cited by examiner

*Primary Examiner* — Richard A. Smith

(74) *Attorney, Agent, or Firm* — Dilworth & Barrese, LLP.

(57) ABSTRACT

A device (1) for removable attachment of a flag (5) on a flagpole (9), where the flag comprises a holder (7) adapted to receive one end of a flagpole (11). The device comprises a body (25) which one end comprises means (15) for attaching the device at one end of a flagpole and which other end is provided with a protruding element (20) arranged to in interaction with the holder hold the flag at the flagpole. The protruding element comprises an inner part (21) with a cross section that is less than the cross section of the body and an outer part (23) with a cross section that is larger than the cross section of the inner part. The outer part is arranged so that it allows an elastic compression so that its cross section decreases when its subjected to a lateral force (F) and so that its cross section resumes its original cross section when the force ceases.

18 Claims, 3 Drawing Sheets

DEVICE FOR REMOVABLE ATTACHMENT OF A FLAG ON A FLAGPOLE

TECHNICAL FIELD

The present invention relates to a device for removable attachment of a flag on a flagpole, where the flag comprises a holder adapted to receive one end of the flagpole, wherein the device comprises a body whose one end comprises means for attaching the device at one end of a flagpole and whose other end is provided with a protruding element arranged to in interaction with the holder hold the flag at the flagpole.

The present invention further relates to a flag unit comprising a flagpole, a flag with a holder adapted to receive one end of a flagpole and a device for removable attachment of the flag on the flagpole, wherein the holder comprises an opening and the device comprises a body which one end comprises means for attaching the device at one end of a flagpole and which other end is provided with a protruding element arranged to in interaction with the opening in the holder hold the flag at the flagpole.

PRIOR ART

In known devices and flag units, a flag with a holder on the flagpole is mounted by means of that an end of a flagpole is guided through an opening at the holder to a mounted state. At the mounted state a device with a protruding element is attached to the end of a flagpole by means of a screw joint, wherein the flag holder with flag is detained at the flagpole. When the flag is removed from the flagpole the device is unscrewed, where after the flag is lifted from the flagpole.

FIG. 1 discloses a flag unit 1 comprising a device 3 for removable attachment of a flag 5 on a flagpole 9 according to prior art. The flag 5 comprises a holder 7. The device 3 is being screwed to the end of a flagpole 11 when the flag 5 is in a mounted state on the flagpole 9. The device 3 is unscrewed from the end of the flagpole 11 when the flag 5 is to be removed from the mounted state on the flagpole 9.

In some field of applications flags need to be switched often. At a golf course flags needs to be changed frequently, for example when arranging a new arrangement of the golf holes, at golf competition where flags displays the current sponsor of the competitions, etcetera. Shop keeper needs to shift flags often in order to display new sales campaigns, sales offer, etcetera. Accordingly there are many field of applications where flags need to be changed frequently.

A problem with known devices is that a change from a first flag to a second flag is time consuming by means of that the device must be unscrewed from the end of the flagpole before the flag can be removed. In the same manner, the device must be attached to the end of the flagpole after a new flag has been guided to the mounted state around the flagpole. Another occurring problem with the state of the art is that it is difficult to screw or unscrew the device to or from the end of the flagpole due to corrosion or other interaction at the screw joint between the device and the end of the flagpole.

SUMMARY OF INVENTION

The object of the present invention is to provide a device and a flag unit that solves the problem with devices according to prior art. The invention provides a flexible and quick way of attaching a flag and to removing the flag from the flagpole without that the device is removed from the end of the flagpole.

This object is achieved by the previous stated devices according to the description herein, that is characterized in that the protruding element comprises an inner part with a cross section that is less than the cross section of the body and an outer part with a cross section that is larger than the cross section of the inner part, wherein the outer part is arranged so that it provides an elastic compression in that its cross section decreases when it is subjected to a lateral force and so that its cross section resumes to its original cross section when the force ceases.

At least the outer part has elastic properties that results in that the outer part provides the elastic compression when it is subjected to the lateral force. By the term lateral force is to be understood a force in a direction of the outer part. By the term elastic compression is to be understood that the outer part is compressed at interaction from the lateral force and at ceasing of the lateral force return to its original cross section. Accordingly, a certain lateral force is needed to compress the outer part to such an extent that the protruding element no longer interacts with the holder in holding the flag at the flagpole, wherein the flag is allowed to be removed from the flagpole. At the same compression of the protruding element the flag is allowed to be displaced over protruded element to a mounted state.

According to an embodiment of the invention, the outer part of the protruding element is at least spherical. Thereby, at least a part of the outer part of the protruding element comprises a spherical part. For example, the outer part comprises a full sphere. Alternatively, the upper part of the outer part comprises a cut off sphere and or a lower part of the outer part comprises a cut off sphere. Thereby, the lateral force is increasing gradually when the flag is displaced towards the outer part of a protruding element, wherein the compression occurs gradually.

According to an embodiment of the invention at least the outer part of the protruding element is arranged in an elastic material. The elastic material has properties that allows the elastic compression of the outer part of the protruding element. For example, the elastic material is a polymeric or a metallic material. Preferably, the elastic material is a polymeric material from the group of polyethylene, polypropene, polytetrafluoroethylene, pomacetal, etcetera.

According to an embodiment of the invention, the protruding element is arranged with at least one open groove arranged to provide a space for mentioned elastic compression, wherein the groove separates the protruding element in two or more elastic parts.

At compression a displacement of parts of a material of the outer part of the protruding element occurs. The space receives the displaced material without that the material as such is compressed so that its density is changed. Thereby, it is possible to use elastic material that requires a high force to be compressed so that its density is changed. The elastic parts have a resilient effect so that they, at an interaction of the lateral force, are pressed in the direction inward the outer part and at ceasing of the lateral force resumes their original state.

According to an embodiment of the invention the protruding element is arranged with two of mentioned open grooves, which are arranged essentially perpendicular to each other, wherein the grooves separate the protruding element in four elastic parts.

The object of the invention is also obtained with a flag unit according to the description herein. The flag unit is characterized in that mentioned body has a cross section that is larger than mentioned opening, the protruding element comprises an inner part with a cross section that is less than mentioned opening, and an outer part with a cross section that is somewhat larger than mentioned opening, wherein the outer part is arranged elastically compressible in that by the force that arises when it is pressed towards the area around the opening results in that the cross section of the outer part decreases to such an extent that it is allowed to pass through the opening, and so that the cross section of the outer part resumes its original cross section when the force ceases.

At the elastic compression of the outer part of the protruding element the outer part is compressed at least to the cross section of the opening, wherein the opening is allowed to pass over the outer part. Thereby, the detaining interaction between the opening and the protruding element ceases. Accordingly, the flag is allowed to be removed from or to be mounted at the flagpole at the same time that the device is attached to the end of the flagpole.

According to an embodiment of the invention, the outer part of the protruding element comprises a first tapering part that provides a gradual compression of the outer part when it is pressed towards the area around one side of the opening with the purpose of mounting the flag on the flagpole.

The first tapering part decreases from a part with a largest cross section to the top of an outer part. Thereby, the one side of the opening of the holder is guided towards the largest cross section of the outer part when the flag is mounted on the flagpole. Accordingly, a gradual increasing compression of the outer part arises when the one side of the opening is displaced from the top of the outer part to the largest cross section of the outer part.

According to an embodiment of the invention, the outer part of the protruding element comprises a second tapering part that provides a gradual compression of the outer part when it is pressed towards the area around the other side of the opening with the purpose of removing the flag from the flagpole.

The second tapering part decreases from a part with a largest cross section to the inner part of the protruding element. Thereby, the other side of the opening of the holder is guided towards the largest cross section of the outer part when the flag is being removed from the flagpole. Accordingly, a gradual increasing compression of the outer part arises when the other side of the opening is displaced from the inner part to the largest cross section of the outer part.

BRIEF DESCRIPTION OF THE DRAWINGS

The invention will now be explained in detail with reference to different embodiments of the invention and with reference to the attached figures.

DETAILED DESCRIPTION OF PREFERRED EMBODIMENTS OF THE INVENTION

Figure 1:
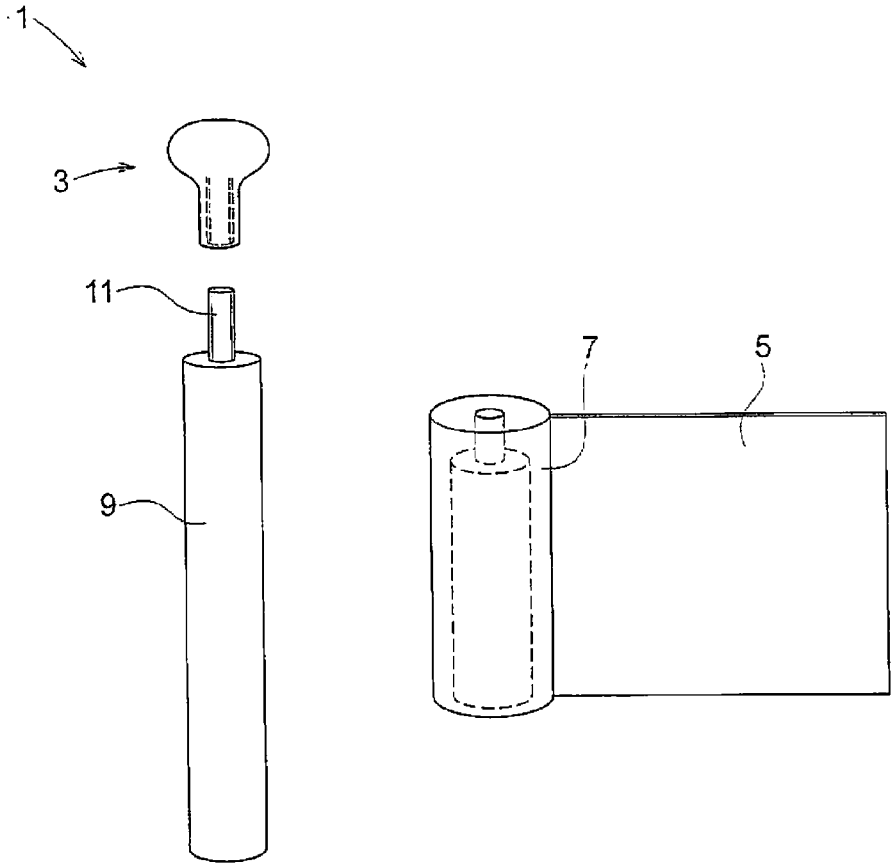
Fig. 1 PRIOR ART
FIG. 1 discloses a prior art flag unit comprising a device for removable attachment of a flag on a flagpole.
Figure 2:
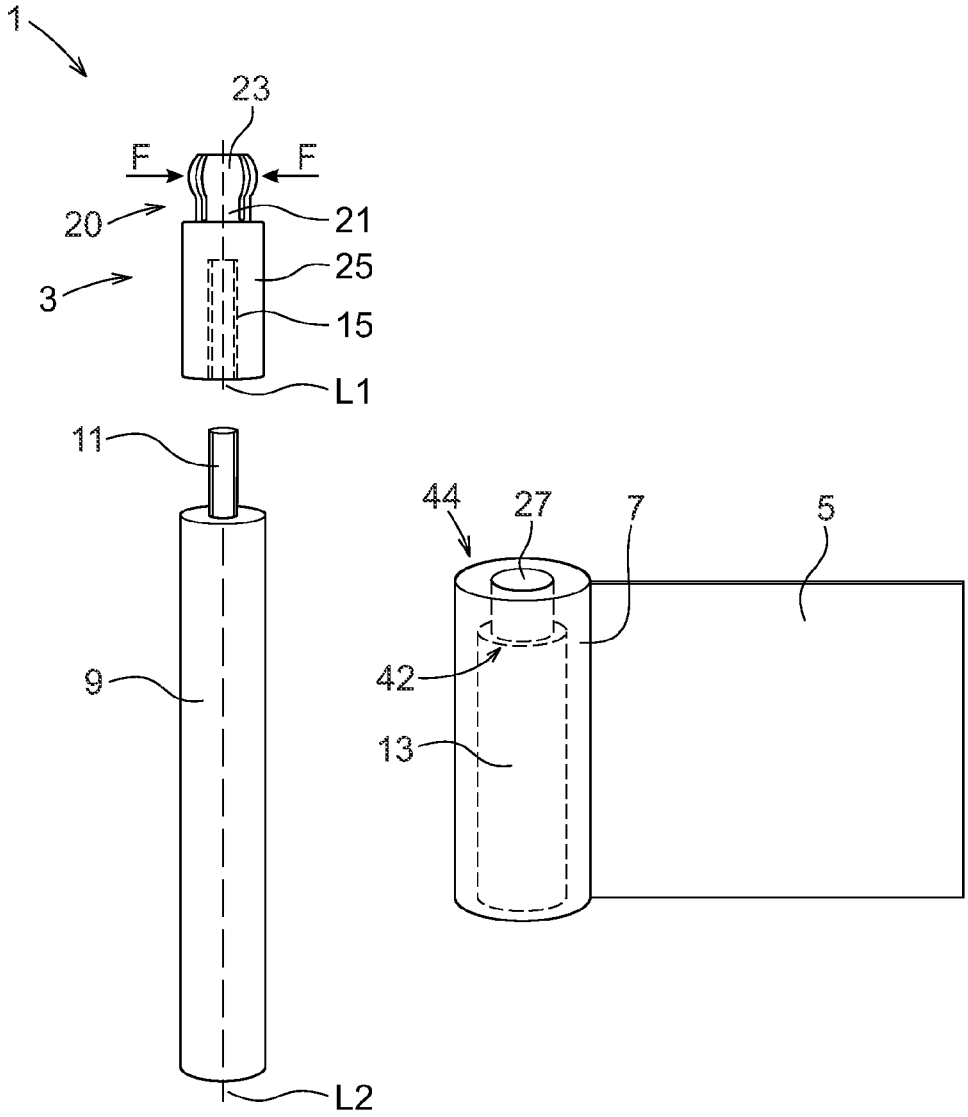
FIG. 2 discloses a flag unit comprising a device for removable attachment of a flag on a flagpole according to the invention.

FIG. 2 discloses a flag unit 1 comprising the device 3 for removable attachment of a flag 5 according to the invention, wherein the device 3 comprises elastic compressible properties. The flag 5 comprises a holder 7. The holder 7 comprises a space 13. The space 13 is adapted to receive one end of the flagpole 9, wherein the holder 7 is guided along the flagpole 9 to a mounted state. The device 3 comprises a longitudinal body 25, which one end comprises means 15 for attaching the device 3 at the end 11 of the flagpole, such as by means of a screw joint, a bolt joint, etcetera. The end 11 of the flagpole 9 is adapted to receive the device 3 and to provide attachment of the device 3. The device 3 is attached directly to the end 11 of the flagpole or by means of an adaptor between the end 11 of a flagpole and the device 3. The device 3 is adapted to remain attached to the end 11 of the flagpole when the flag 5 is displaced to or from the mounted state.

The device 3 comprises a protruding element 20 that is arranged to in interaction with the holder 7 hold the flag 5 at the flagpole 9. The protruding element 20 comprises an inner part 21 and an outer part 23. The inner part 21 has a cross section that is less than the cross section of the body 25. The outer part 23 has a cross section that is larger than the cross section of the inner part 21. The outer part 23 has ability to be elastically compressed when it is subjected to a lateral force F that presses it in towards a centre of the outer part 23, wherein the outer part 23 resumes to its original cross section at lack of the lateral force F. At a certain compression the holder 7 can pass over the protruding element 20. By means of the outer part's 23 ability to be elastically compressed the flag 5 can be displaced to and from the flagpole 9 at the same time that the device 3 is being attached to the end 11 of the flagpole 9.

The holder 7 comprises an opening 27. The object of the holder 7 is to detain the flag 5 and to subject the device 3 with the lateral force F. The holder 7 comprises a mainly a form stable material, such as a polymeric material. The outer part 23 of the protruding element 20 is adapted, in an unstressed state, to protrude outside the circumference of the opening 27 in the holder 7. Thereby, the holder 7 is maintained at the flag 5 at the mounted state around the flagpole 9. The inner part 21 of the protruding element 20 has a cross section that is less than the cross section of the body 25 and less than the outer part 23 at an unstressed state. Accordingly, the inner part 21 provides a form of necking in the unstressed state. In the unstressed state the opening 27 is accordingly positioned around the inner part 21 of the protruding element 20. At the mounted state the flag 5 is accordingly prevented from gliding away from the flagpole 9 due to that wind or similar condition are affecting the flag 5.

The protruding element 20 of the device 3 is adapted to, when the holder 7 is pressed with a certain force towards the outer part 23, create the lateral force F so that the outer part 23 is compressed to the circumference of the opening 27 of the holder 7. Thereby, the opening 27 is allowed to pass over the outer part 23. After mentioned lateral force F ceases, the outer part 23 is expanding again so that the outer part 23 again protrudes outside the circumference of the opening 27 of the holder 7. Thereby, the device 3 provides a flexible and quick manner to mount the flag 5 at and to remove the flag 5 from the flagpole 9 without that the device 3 is removed from the end 11 of the flagpole 9.

Figure 3:
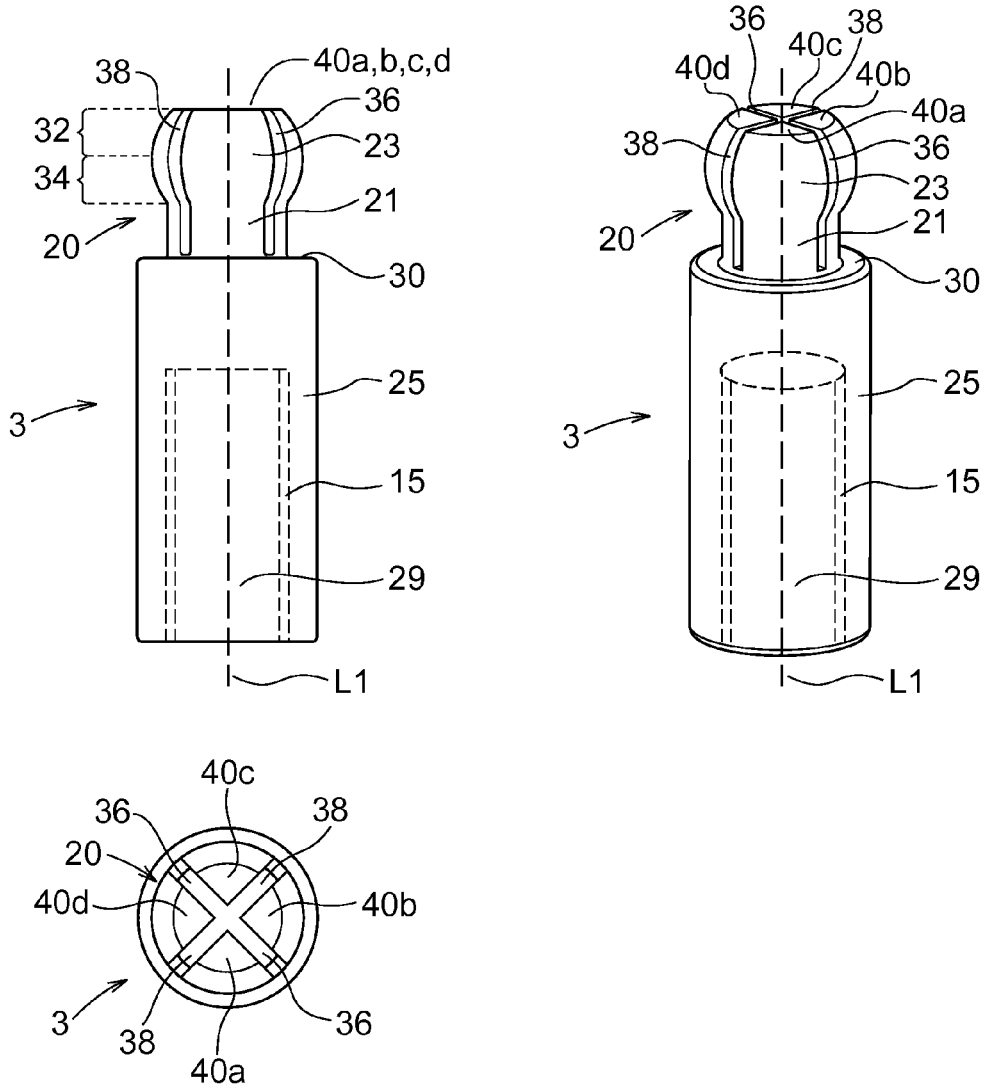
FIG. 3 discloses an example of the device in FIG. 2 in a perspective view, a view from the side and a view from above.

FIG. 3 discloses a detailed reproduction of the device 3 seen in a perspective view, a view from the side and a view from above. The device 3 comprises the longitudinal body 25. The body 25 has a constant cross section with a cylindrical form. One end of the body 25 is provided with a cylindrical hole 29 with an internal threading adapted to be screwed to an outer threading of the end 11 of the flagpole 9. The body 25 has a longitudinal axis L1 that at an attached state on the end 11 of the flagpole 9 coincide with a longitudinal axis L2 of the flagpole 9.

A flat lateral part 30 provides the transition between the inner part 21 of the protruding element 20 and the body 25 of the device 3. The flat part 30 provides a stop position for the holder 7. The area around the one side 42 of the opening 27 is adapted to abut the lateral part 30, see FIG. 2. Thereby, the flag 5 is prevented from being displaced to a position further down the flagpole 9. The outer part 23 of the protruding element 20 prevents the flag 5 from, in the mounted state, to be displaced in a direction away from the end 11 of the flagpole 9. The inner part 21 of the protruding element 20 has a constant cylindrical cross section. The distance between the inner part 21 and the outer part 23 defines the mounted state of the flag 5.

The protruding element 20 comprises a spherical part. A first tapering part 32 and a second tapering part 34 of the protruding element 20 comprise a cut off sphere. By means of the spherical form of the second tapering part 34 a gradual transition is achieved from the inner part 21 of the protruding element 20 to the most protruding part of the outer part 23, when the flag 5 is removed from the flagpole 9. Thereby the lateral part F increases gradually when the holder 7 is displaced from the inner part 21 to the most protruding part of the outer part 23 of the protruding element 20. Accordingly, in the same manner, the elastic compression of the outer part 23 arises gradually. When the first tapering part 32 has a form of a cut off sphere, a gradual increase arises in the lateral force F when the holder is displaced from a free state towards the inner part 21, wherein the compression of the outer part 23 arises gradually.

The one side 42 of the opening 27 is adapted to be brought into contact with the first tapering part 32 so that the first tapering part 32 gradually is compressed. The other side 44 of the opening 27 is adapted to be brought into contact with the other tapering part 34 so that the other tapering part 34 is gradually compressed.

The protruding element 20 comprises two open grooves 36, 38. The groove 36, 38 is arranged perpendicular in respect to each other and has accordingly an X-form when the device 3 is seen from above. The two grooves 36, 38 intersects with each other in the centre of the inner part 21. The top of the outer part 23 comprises four surfaces directed perpendicular to the longitudinal axis L1 of the body 25. In the compressed state the four surfaces forms a common circular surface. The two grooves 36, 38 intersect with each other in the centre of the circular surface of the outer part 23. The grooves 36, 38 extend from the top of the outer part 23 down through the outer part 23 and into the inner part 21 of the protruding element 20 towards the body 25. The grooves 36, 38 extends in parallel with the longitudinal axis L1 of the body 25. By means of the groove 36, 38, the protruding element 20 is separated in four separate elastic parts 40*a*, 40*b*, 40*c*, 40*d*. The groove 36, 38 provides a space for the elastic compression of the outer part 23 and the inner part 21 of the protruding element 20. At compression the separate parts is pressed towards each other, wherein the cross section of the outer part 23 and the inner part 21 are decreasing.

The protruding element 20 comprises a polymeric material such as polyethylene, polypropene, polytetrafluoroethylene, pomacetal, etcetera. Preferably the whole device 3 is manufactured from one polymeric material.

The invention is not limited to the disclosed embodiments but may be modified and varied within the framework of the following claims.

The invention claimed is:

1. A device (3) for removable attachment of a flag (5) on a flagpole (9), where the flag (5) comprises a holder (7) adapted to receive one end (11) of the flagpole (9), wherein the device (3) comprises a body (25) in which one end comprises means (15) for attaching the device (3) at one end of the flagpole (9) and in which the other end is provided with a protruding element (20) adapted to interact with the holder (7) in holding the flag (5) at the flagpole (9), the protruding element (20) comprises an inner part (21) with a cross section that is less than a cross section of the body (25) and an outer part (23) with a cross section that is larger than the cross section of the inner part (21), and the outer part (23) is arranged so that it allows an elastic compression by decreasing its cross section when it is subjected to a lateral force (F) and resuming its original cross section when the force (F) ceases.

2. A device (3) according to claim 1, wherein the outer part (23) of the protruding element (20) is at least partly spherical.

3. The device (3) according to claim 2, wherein at least the outer part (23) of the protruding element (20) includes elastic material.

4. The device (3) according to claim 3, wherein the protruding element (20) is arranged with at least one open groove (36, 38) adapted to provide a space for elastic compression, and the groove (36, 38) separates the protruding element (20) into two or more elastic parts (40*a*, 40*b*, 40*c*, 40*d*).

5. The device (3) according to claim 4, wherein the protruding element (20) is arranged with two open grooves (36, 38) which are arranged essentially perpendicular to each other, and the grooves (36, 38) separate the protruding element (20) into four elastic parts (40*a*, 40*b*, 40*c*, 40*d*).

6. A device (3) according to claim 1, wherein at least the outer part (23) of the protruding element (20) includes elastic material.

7. A device (3) according to claim 6, wherein the protruding element (20) is arranged with at least one open groove (36, 38) adapted to provide a space for elastic compression, and the groove (36, 38) separates the protruding element (20) in two or more elastic parts (40*a*, 40*b*, 40*c*, 40*d*).

8. A device (3) according to claim 7, wherein the protruding element (20) is arranged with two open grooves (36, 38) which are arranged essentially perpendicular to each other, and the grooves (36, 38) separate the protruding element (20) in four elastic parts (40*a*, 40*b*, 40*c*, 40*d*).

9. Use of a device (3) according to claim 1 for changing flags on a golf track.

10. Flag unit (1) comprising:

a flagpole (9), a flag (5) with a holder (7) adapted to receive one end (11) of the flagpole (9) and a device (3) for removable attachment of a flag (5) on the flagpole (9), wherein the holder (7) comprises an opening (27) and the device (3) comprises a body (25) in which one end comprises means (15) for attaching the device (3) at one end (11) of the flagpole (9) and in which the other end is provided with a protruding element (20) adapted to interact with the opening (27) in the holder (7) in holding the flag (5) at the flagpole (9), the body (25) has a cross section that is larger than the opening (27), the protruding element (20) comprises an inner part (21) with a cross section that is less than the opening (27), and an outer part (23) with a cross section that is larger than the opening (27), and the outer part (23) is arranged elastically compressible by a force (F) that arises when the outer part (23) is pressed within the opening (27), which results in the cross section of the outer part (23) decreasing to an extent allowing the outer part (23) to pass through the opening (27), and the cross section of the outer part (23) resuming its original cross section when the force (F) ceases.

11. The flag unit (1) according to claim 10, wherein the outer part (23) of the protruding element (20) comprises a first tapering part (32) that provides a gradual compression of the outer part (23) when the outer part (23) it is pressed towards an area around one side (42) of the opening (27) with the purpose of attaching the flag (5) on the flagpole (9).

12. The flag unit (1) according to claim 11, wherein the outer part (23) of the protruding element (20) comprises a second tapering part (34) that provides a gradual compression of the outer part (23) when the outer part (23) is pressed towards an area around the other side (44) of the opening (27) with the purpose of removing the flag (5) from the flagpole (9).

13. The flag unit (3) according to claim 12, wherein at least the outer part (23) of the protruding element (20) includes elastic material.

14. The flag unit (3) according to claim 13, wherein the protruding element (20) is arranged with at least one open groove (36, 38) adapted to provide a space for elastic compression, and the groove (36, 38) separates the protruding element (20) into two or more elastic parts (40*a*, 40*b*, 40*c*, 40*d*).

15. The flag unit (3) according to claim 11, wherein at least the outer part (23) of the protruding element (20) includes elastic material.

16. The flag unit (3) according to claim 15, wherein the protruding element (20) is arranged with at least one open groove (36, 38) adapted to provide a space for elastic compression, and the groove (36, 38) separates the protruding element (20) into two or more elastic parts (40*a*, 40*b*, 40*c*, 40*d*).

17. The flap unit (3) according to claim 10, wherein at least the outer part (23) of the protruding element (20) includes elastic material.

18. The flag unit (3) according to claim 17, wherein the protruding element (20) is arranged with at least one open groove (36, 38) adapted to provide a space for elastic compression, and the groove (36, 38) separates the protruding element (20) into two or more elastic parts (40*a*, 40*b*, 40*c*, 40*d*).

* * * * *